US005910078A

United States Patent [19]

Guttinger et al.

[11] Patent Number: 5,910,078

[45] Date of Patent: Jun. 8, 1999

[54] ROTARY OBJECT FEEDER

[75] Inventors: Peter Guttinger, Milton; Tony Spadafora, Ancaster; Michael Elent, Vaughan, all of Canada

[73] Assignee: H. J. Langen & Sons, Inc., Mississauga, Canada

[21] Appl. No.: 08/920,880

[22] Filed: Aug. 29, 1997

Related U.S. Application Data

[63] Continuation of application No. 08/535,945, Sep. 28, 1995, abandoned.

[51] Int. Cl.[6] ..... B31B 1/78

[52] U.S. Cl. ..... 493/309; 493/315; 493/317; 414/736; 414/737

[58] Field of Search ..... 493/122–124, 493/309, 312, 313, 315–318, 424, 450, 126, 127; 414/736, 737; 271/91, 94, 95; 53/566, 381.1

[56] References Cited

U.S. PATENT DOCUMENTS

| | | | |
|---|---|---|---|
| 3,026,989 | 3/1962 | Schaltegger | 414/737 |
| 3,882,998 | 5/1975 | Hunter | 198/287 |
| 4,194,442 | 3/1980 | Martelli | 493/315 |
| 4,514,181 | 4/1985 | Hughes | 493/131 |
| 4,518,301 | 5/1985 | Greenwell | 414/129 |
| 4,530,686 | 7/1985 | Everson et al. | 493/315 |
| 4,537,587 | 8/1985 | Langen | 493/315 |
| 4,582,315 | 4/1986 | Scarpa et al. | 271/150 |
| 4,596,545 | 6/1986 | Greenwell | 493/315 |
| 4,601,691 | 7/1986 | Greenwell | 493/313 |
| 4,625,575 | 12/1986 | Le Bras | 74/63 |
| 4,643,633 | 2/1987 | Lashyro | 414/736 |
| 4,773,525 | 9/1988 | Gertitschke et al. | 198/471.1 |
| 4,830,172 | 5/1989 | Hilton et al. | 198/392 |
| 4,869,486 | 9/1989 | Scarpa et al. | 271/3.1 |
| 4,871,348 | 10/1989 | Konaka | 493/315 |
| 4,901,843 | 2/1990 | Lashyro | 198/418.3 |
| 4,902,192 | 2/1990 | Ziegler | 414/736 |
| 4,934,682 | 6/1990 | Rece et al. | 271/3.1 |
| 4,998,910 | 3/1991 | Mohaupt et al. | 493/12 |
| 5,023,974 | 6/1991 | Coles | 452/177 |
| 5,028,044 | 7/1991 | Fischer | 271/91 |
| 5,037,018 | 8/1991 | Matsuda et al. | 222/650 |
| 5,176,612 | 1/1993 | Calvert et al. | 493/315 |
| 5,188,411 | 2/1993 | Golden | 294/64.2 |

(List continued on next page.)

FOREIGN PATENT DOCUMENTS

| | | |
|---|---|---|
| 1204798 | 5/1986 | Canada . |
| 1225109 | 8/1987 | Canada . |
| 2066837 | 10/1992 | Canada . |
| 1330219 | 6/1994 | Canada . |
| 0132617 | 2/1985 | European Pat. Off. . |
| 0134628 | 3/1985 | European Pat. Off. . |
| 0148345 | 7/1985 | European Pat. Off. . |
| 0580958 | 2/1994 | European Pat. Off. . |
| 2487310 | 1/1982 | France . |
| 2192602 | 1/1988 | United Kingdom . |

*Primary Examiner*—Michael J. Carone
*Assistant Examiner*—Darren Ark
*Attorney, Agent, or Firm*—Jacobson, Price, Holman & Stern, PLLC

[57] ABSTRACT

The present invention is directed to a rotary object feeder, which feeds objects from a first location to a second. The object feeder feeds the object from a pick-up location to an off-loading location, by moving an object pick-up member along a trajectory formed by rotating the object pick-up member about a first axis of rotation; rotating this first axis of rotation about a second axis of rotation substantially parallel to the first axis of rotation and spaced therefrom; rotating the second axis of rotation about a third axis of rotation substantially parallel to the second axis of rotation and spaced therefrom. The invention is particularly suited for use in a rotary carton feeder having numerous suction cup pick-up members, used to feed cartons from a pick-up location, through an operating location to a drop-off location. The relative rates of rotation of the pick-up members may be chosen to minimize their tangential velocities at the pick-up, operating or drop-off locations. The invention is particular well suited for use as a rotary carton feeder.

40 Claims, 13 Drawing Sheets

U.S. PATENT DOCUMENTS

| | | | |
|---|---|---|---|
| 5,201,560 | 4/1993 | Golden | 294/64.2 |
| 5,215,515 | 6/1993 | Bershadsky | 493/315 |
| 5,234,304 | 8/1993 | Okumoto et al. | 414/225 |
| 5,234,314 | 8/1993 | Ganz | 414/797.8 |
| 5,249,916 | 10/1993 | Portrait et al. | 414/798.9 |
| 5,254,071 | 10/1993 | Laroche | 271/91 |
| 5,371,995 | 12/1994 | Guttinger et al. | 53/251 |
| 5,411,464 | 5/1995 | Calvert et al. | 493/315 |
| 5,431,274 | 7/1995 | Schaupp | 198/474.1 |
| 5,456,570 | 10/1995 | Davis et al. | 414/742 |
| 5,603,599 | 2/1997 | Wesslen et al. | 493/317 |

ROTARY OBJECT FEEDER

This is a continuation of application Ser. No. 08/535,945, filed Sep. 28, 1995 which was abandoned upon the filing hereof.

FIELD OF THE INVENTION

This invention is directed to an object feeder, more particularly to a rotary object feeder that feeds an object by rotating the object about three parallel, axes of rotation.

BACKGROUND OF THE INVENTION

Numerous rotary object feeders are known. For example, U.S. Pat. No. 4,518,301 issued May 21, 1985 to R. A. Jones & Co. Inc., discloses an orbital feeder suited for picking up folded cartons from a storage magazine, unfolding them and transporting them to a conveyor, where they are released.

The difficulties with rotary feeders are numerous. The objects to be picked up, such as folded cartons in a magazine, are stationary. It is therefore not possible to simply wipe past the cartons with a pick-up member, typically a suction cup, rotating past the object, with any degree of reliability. Accordingly, a solution to overcome this problem is to alter the path of the pick-up members so that they make contact with the object as they are travelling in a direction generally perpendicular to the plane of the cartons. Rotary carton feeders implementing this solution are known, and incorporate suction cups used as pick-up members mounted on planetary elements. The suction cups move along a hypocycloidal path, and will pick-up objects at points along their path where the suction-cups are travelling in a direction which is perpendicular to the objects. However, because the additional rotation of a planetary element, the perpendicular movement may be somewhat abrupt. Additionally, the object to be picked up is rotated about an additional axis, which may significantly increase the net velocity of the object at certain points along its path. Accordingly, object feeders using this solution do not lend themselves to operation at high speeds. Furthermore to achieve the desired movement, the object is rotated inwardly toward a central axis. This restricts the size and number of objects that can be handled simultaneously by the object feeder.

SUMMARY OF THE INVENTION

The present invention is directed to a rotary object feeder, which feeds objects from a first location to a second location by rotating the object about three axes. The object feeder feeds the object from a pick-up location to an off-loading location, by moving an object pick-up member along a trajectory formed by rotating the object pick-up member about a first axis of rotation; rotating this first axis of rotation about a second axis of rotation substantially parallel to the first axis of rotation and spaced therefrom; rotating the second axis of rotation about a third axis of rotation substantially parallel to the second axis of rotation and spaced therefrom. The first, second and third axes of rotation may be analogized to moon, planet and sun axes in a solar system.

The resulting trajectory of the object about a third axis is hypocycloidal. The object passes at least one point at which the object is at a farthest distance from this third axis. This farthest location is reached when the object, the first axis, the second axis and the third axis of rotation are collinear. This location can be considered a vertex of the object's trajectory.

At this point, the object will change its radial direction away from the first axis toward the second axis. The number of vertices along the object's trajectory as the object rotates about the third axis will vary depending on the relative rates of rotation of the first axis about the second axis and the second axis about the third axis.

For example, if the first axis is rotated more quickly about the second axis than the second axis is rotated about the third axis, the object's trajectory will have at least one vertex for each rotation of the object about the third axis. Similarly, if the first axis rotates about the second axis at a rate of rotation slower than that of the second axis about the third axis, the object will only reach a vertex of its trajectory after the second axis has rotated about the third axis at least once.

Additionally, the choice of distances from the third axis to the second axis; from the second axis to the third axis; and from the third axis to the object combined with the relative rates of rotation of the object about its three axes may be chosen to minimize the tangential velocity of the object in its orbit about the third axis at these vertices.

Ideally, the rate of rotation of the second axis about the third axis (angular velocity $\omega_1$), and the rate of rotation of the first axis about the second axis (angular velocity $\omega_2$) will be chosen as integer multiples of each other, with $\omega_2>\omega_1$ . Thereby the trajectory of the object will have $\omega_2/\omega_1$ vertices for each rotation of the second axis about the third axis. The location of these vertices relative to some fixed point, (for example, the location of the third axis) may be arbitrarily selected and will remain the same for each rotation of the second axis about the third axis.

The use of three axes of rotation further permits the object as it rotates about the third axis to face generally outward from the third axis at all times. Thus when the invention is embodied in a rotary object feeder, relatively large objects may be picked-up and transported on a rotary carrier. The objects remain generally on the periphery of the carrier without being rotated toward its centre. Additionally, the path taken by the object may be made smoother and its velocity may be minimized if the object is rotated about the third axis at an angular velocity equal in magnitude but opposite in direction to the magnitude and direction of the angular velocity of the first axis about the second axis. As a result, rotary object feeders in accordance with this invention lend themselves to use at very high speeds.

A rotary object feeder in accordance with this invention need not be limited to a single pick-up member mounted rotatable about three axis. An object feeder in accordance with this invention may have any number of pick-up members, each having arbitrary rates of rotation about a first, second and third axis. In this way, the invention may extend to a rotary carton feeder, in which the pick-up members may be analogized to moons in a solar system having numerous planets.

As the preferred embodiments detailed herein reveal, this invention is particularly well suited for use with a rotary carton feeder which will have enhanced advantages when numerous planetary members are mounted about a third axis such that the pick-up members reach vertices along their trajectories at equidistant points from the third axis. Moreover, if numerous pick-up members rotate about a third axis, it will be advantageous if a number of these pick-up members travel along identical trajectories so that they reach the vertices of their paths at the same locations. The vertices may then be used as pick-up, operating and drop-off stations for an object.

In accordance with one aspect of the present invention, there is provided, a rotary object feeder, comprising: a support; a carrier member rotatably mounted to said support at a sun axis of rotation; a planetary member rotatably mounted to said carrier member at a planetary axis of rotation spaced from said sun axis of rotation; a moon member rotatably mounted to said planetary member at a moon axis of rotation spaced from said planetary axis of rotation; an object pick-up member mounted to said moon member; said sun axis of rotation, said planetary axis of rotation and said moon axis of rotation being substantially parallel; means for continuously rotating said carrier member, said planetary member, and said moon member at fixed relative angular velocities, with at least one of said planetary member and said moon member rotating in a direction opposite to that of said carrier member, such that said pick-up member moves through a pick-up location at a reduced velocity relative to said support.

In accordance with another aspect of the invention a rotary object feeder, comprises (a) a support;

(b) a carrier member rotatably mounted to the support at a sun axis of rotation;

(c) first and second planetary systems, each planetary system comprising:

(i) a planetary member rotatably mounted to the carrier member at a planetary axis of rotation spaced from the sun axis of rotation;

(ii) a moon member rotatably mounted to the planetary member at a moon axis of rotation spaced from the planetary axis of rotation;

(iii) an object pick-up member mounted to the moon member;

said sun axis of rotation, and said planetary axes of rotation and said moon axes of rotation being substantially parallel;

means for continuously rotating said carrier member, said planetary members, and said moon members at fixed relative angular velocities, with at least one of said planetary member and said moon member in each planetary system rotating in a direction opposite to that of said carrier member, such that each of said pick-up members moves through a pick-up location at a reduced velocity relative to said support.

In accordance with another aspect of the present invention, there is provided a method for feeding an object from a pick-up location to an off-loading location, comprising the steps of: moving an object pick-up member along a trajectory by (a) rotating said object pick-up member about a first axis of rotation; (b) rotating said first axis of rotation about a second axis of rotation substantially parallel to said first axis of rotation and spaced therefrom; (c) rotating said second axis of rotation about a third axis of rotation substantially parallel to said second axis of rotation and spaced therefrom; the rotation of at least one of steps (b) and (c) being in a direction opposite to the direction of rotation of step (a); picking up an object with said pick-up member at a pick-up location along said trajectory; and releasing said object at an off-loading location along said trajectory.

The preferred embodiments described herein are directed to

Embodiment 1—a rotary carton feeder having three pick-up members, travelling along an identical trajectory having three vertices along its path;

Embodiment 2—a rotary carton feeder having six pick-up members, each pick-up member travelling along a trajectory having three vertices, three of the pick-up members travelling along one trajectory, three other pick-up members travelling along a different trajectory;

Embodiment 3—a rotary carton feeder having six pick-up members, each pick-up member travelling along an identical trajectory having three vertices; and Embodiment 4—a rotary carton feeder having six pick-up members, each pick-up member travelling along an identical trajectory having six vertices.

DESCRIPTION OF THE DRAWINGS

In the drawings which illustrate preferred embodiments of the present invention.

DETAILED DESCRIPTION OF THE PREFERRED EMBODIMENTS

Embodiment 1

Figure 1:
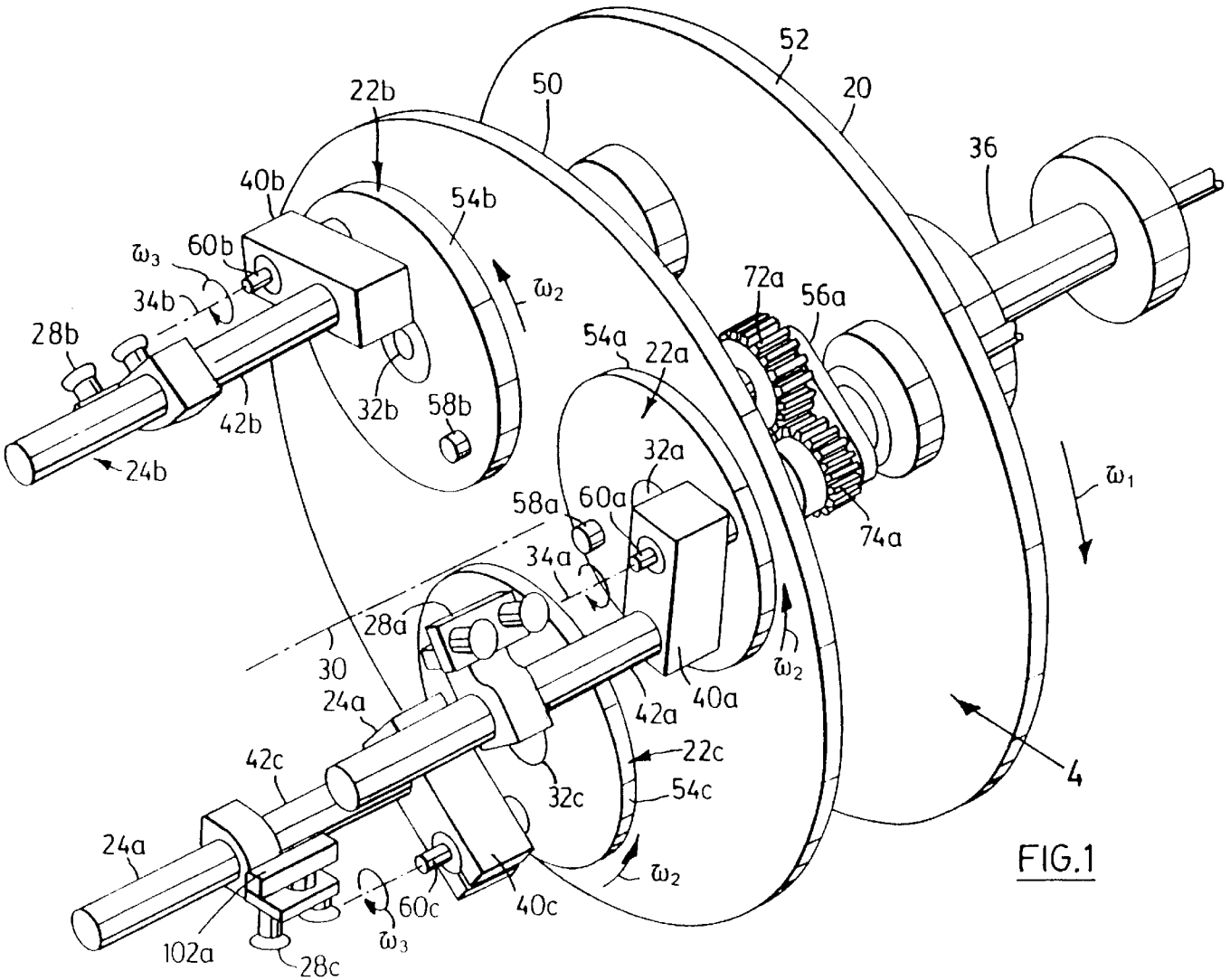
FIG. 1 is a perspective view of an object feeder having 3 pick-up heads, in accordance with one aspect of the present invention.

With reference to FIGS. 1–6, there is provided a rotary object feeder generally designated 18 having three identical planetary members 22*a*, 22*b* and 22*c*.

As shown in FIGS. 1, 3, 4, 5 and 6, there is provided a rotary object feeder 18 having a carrier member 20. Carrier member 20 is comprised of two circular disks 50 and 52. Disks 50 and 52 are made of a durable, rigid material such as steel or aluminum. A main shaft 36 is fixedly mounted to disk 52. Main shaft 36 is coaxial with a sun axis 30. A sun gear 38 is fixedly mounted on a support frame 16, adjacent to the rear side of disk 52 farthest from disk 50. Sun gear 38 is mounted on main shaft 36 and has a centre axis coincident with sun axis 30. Shaft 36 is rotatable relative to fixed sun gear 38.

Three identical planetary members 22*a*, 22*b* and 22*c* are mounted on carrier member 20. The three planetary members are mounted about planetary axes 32*a*, 32*b* and 32*c* at equal distances from sun axis 30, and at equal distances from each other. Only one planetary member 22*a* will be described herein in detail but it will be understood that planetary members 22*b* and 22*c* are identical in structure.

Planetary member 22*a* is rotatably mounted on carrier member 20 about a planetary axis 32*a*. Planetary axis 32*a* is oriented parallel to sun axis 30. Planetary member 22*a* is comprised of circular disk 54*a* and a lever 56*a*. Circular disk 54*a* and lever 56*a* are made of a material similar to that of circular disks 50 and 52. Circular disk 50 has a circular cut-out for seating planetary member 22*a* and particularly disk 54*a* and accordingly may, if desired be mounted with its outer surface flush with the outer surface of disk 50. Bearings 80*a* are interposed between disk 50 and disk 54*a*.

An idler gear 44*a* is rotatably mounted on disk 52 about shaft 33*a* so that it is freely rotatable about shaft 33*a* relative to disk 52 on the side of disk 52 farthest from disk 50. Idler gear 44*a* engages sun gear 38. Idler gear 44*a* also engages a planetary gear 46*a*. Planetary gear 46*a* is fixedly mounted on planetary shaft 48*a*, near an end of a planetary shaft 48*a*. Planetary shaft 48*a* extends through a cut away in circular disk 52, and through a cut away in lever 56*a*. A fixing shaft 58*a* is attached at one end to disk 54*a* and at another to lever 56*a*. Fixing shaft 58*a* acts as a counterweight mounted between disk 54*a* and lever 56*a*, diametrically opposite moon shaft 60*a* and is adapted in combination with the shaping of lever 56*a* to balance the weight of planetary system 22*a* about planetary shaft 48*a*, thereby providing a smooth balanced rotation about axis 32*a*.

A second end of planetary shaft 48*a* is fixedly attached to disk 54*a* at the centre of disk 54*a*. A housing 62*a* is fixedly mounted to the inner side of circular disk 52 and surrounds planetary shaft 48*a*. Ball bearings 84*a* are mounted in housing 62*a* and are interposed between planetary shaft 48*a* relative to housing 62*a*, thus permitting rotation of shaft 48*a* without housing 62*a*. Attached to the end of housing 62*a* proximate an inner side of lever 56*a* closest to lever 56*a*, is a planetary sun gear 70*a*. An idler gear 72*a* is rotatably mounted on an inner side of lever 56*a* closest to circular disk 54*a* on shaft 53*a*, and engages planetary sun gear 70*a*. A moon gear 74*a* is fixedly mounted to moon shaft 60*a*. Moon gear 74*a* is also engaged by idler gear 72*a*.

Moon member 24*a* is fixedly mounted on moon shaft 60*a* on planetary member 22*a* and is rotatable, about moon axis 34*a* with moon shaft 60*a*. Moon member 24*a* has an extension member 40*a* and a shaft 42*a*. Shaft 42*a* extends from extension member 40*a* in a direction parallel to moon axis 34*a*. Extension member 40*a* is mounted to moon shaft 60*a* near one of its ends. 34. Extension member 40*a* is generally rectangular in shape, made of a rigid material, and mounted near one of its ends with its long axis perpendicular to moon axis 34*a*. Object pick-up member 26*a* is fixedly mounted on shaft 42*a* and has a pair of vacuum suction cups 28*a*.

Mounted on shaft 42*a* atop suction cups 28*a* is a vacuum generator 102*a*. Vacuum generator 102*a* uses compressed air at one inlet and converts this compressed air into a stream of attracted air (ie. a vacuum). A vacuum generator suitable for use with this invention, is produced by Pisco™ Pneumatic Equipment, sold under model No. H10-016C or H10-018C. Vacuum generator 102*a* is connected to one end of hose 110*a*. The other end of hose 110*a* is connected to nib 104*a*. Hose 110*a* thus provides a means of air communication between vacuum generator 102*a* and nib 104*a*. Nib 104*a* extends in a direction along axis 32*a* from moon shaft 60*a* which is hollow. The hollow interior of moon shaft 60*a* forms an air passage 114*a* from an end connector 106*a* to nib 104*a*. End connector 106*a* is mounted on swivel joint 122*a* which permits end connector 106*a* to rotate about axis 34*a*. End connector 106*a* is connected to an end of hose 112*a*. The other end of hose 112*a* is connected to nib 108*a*. Nib 108*a* extends in a direction perpendicular to axis 32*a* from planetary shaft 48*a* which is also hollow. Planetary shaft 48*a* defines air passage 116*a* which extends from connector 117*a* to nib 108*a*. Connector 117*a* is mounted on swivel joint 121*a* permitting connector 117*a* to rotate about axis 32*a*. Hose 118*a* extends from connector 117*a* to an electronic control valve (not shown). A hose (also not shown) extends from the electronic control valve to manifold 124. The hose is connected to a nib (not shown) on the manifold. Corresponding electronic control valve 130*b* and nib 120*b*, connected to planetary member 22*b*, are however shown. Control valve 130*b* is connected by a hose to nib 120*b* and it controls the air flow to vacuum generator 102*b*. Nib 120*b* extends from manifold 124 and air passage 119*b* extends through hollow shaft 36. A suitable electronic control valve for use in this embodiment is sold by MAC™ Valves as part No. 111B/113B-111CA. Control valve 130*b* is connected to control wires (not shown) which extend to slip ring 37, as described below. A computer control system 140, as shown schematically in FIG. 4*a* provides control valve 130*b* with appropriate control signals to activate and de-activate the flow of compressed air to vacuum generator 102*b*. A connector 126 extending from an end of shaft 36 is connected to a source of air pressure (not shown).

Extension member 40*a* and shaft 42*a* are designed so that suction cups 28*a* have their pick-up surface along moon axis 34*a*.

Figure 5:
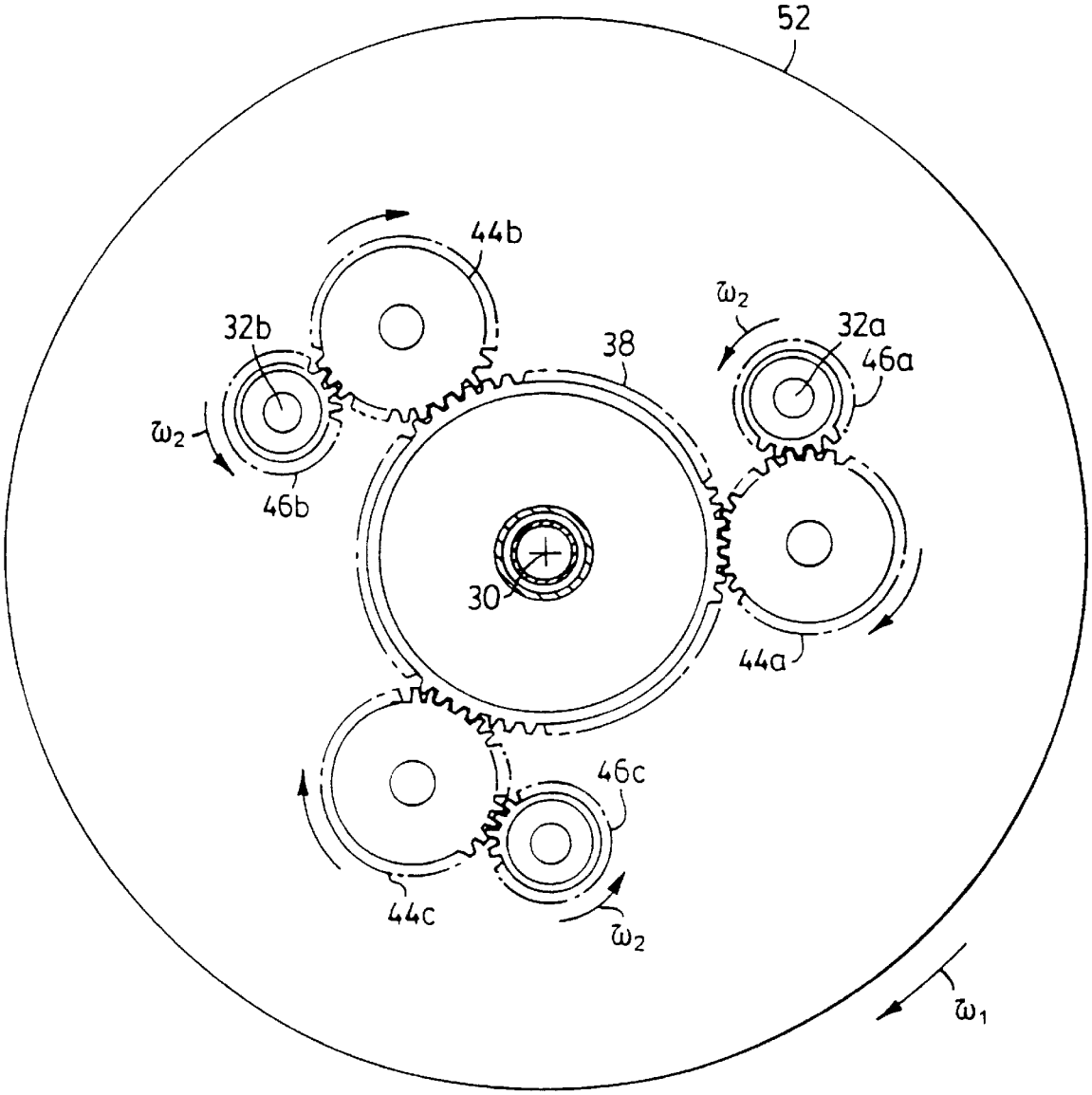
FIG. 5 is an end view of the embodiment of FIG. 1, taken along 5—5 of FIG. 4.
Figure 6:
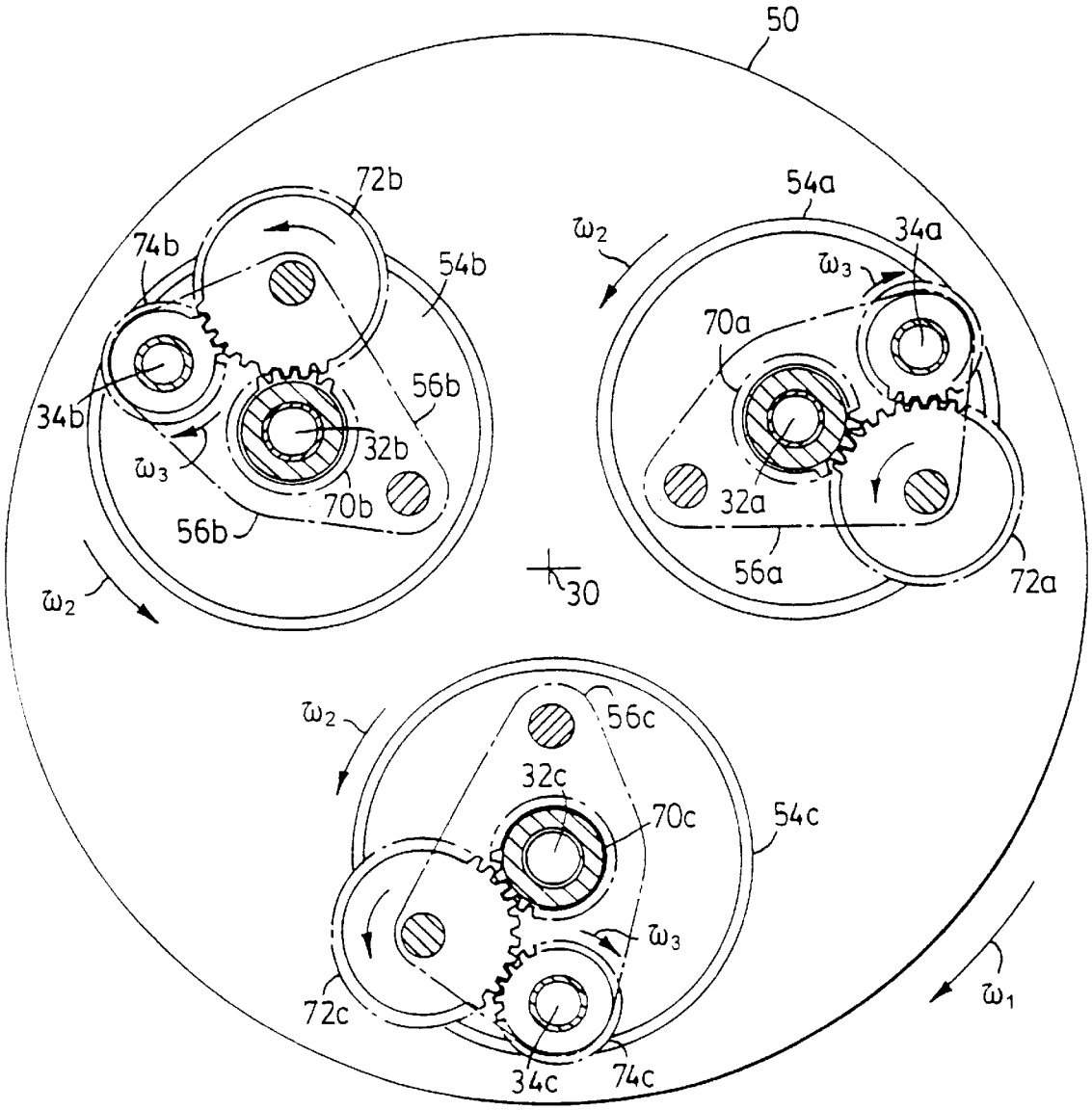
FIG. 6 is an end view of the embodiment of FIG. 1, taken along 6—6 of FIG. 4.

In operation, a source of rotational power drives shaft 36 at an angular velocity of 107 $_1$. A source of positive air pressure is fed to connector 126. Shaft 36 causes disk 52 and disk 50 along with planetary members 46*a*, 46*b* and 46*c* and their corresponding planetary axis, to rotate about the sun axis 30 at angular velocity $\omega_1$ and relative to sun gear 42. Consequently, idler gear 44*a* is driven about sun gear 38 and engages sun gear 38 to cause idler gear 44*a* to rotate about its shaft 33*a* in a direction the same as the direction of rotation of disk 52, as illustrated in FIG. 5. Planetary spur gear 46*a* is engaged by idler gear 44*a* and is rotated about its planetary axis 32*a* in the opposite direction as idler gear 44*a* and disc 52 at an angular velocity $\omega_2$. Planetary spur gear 46*a*, fixedly attached to planetary shaft 48*a*, causes planetary shaft 48*a* to rotate with spur gear 46*a*. Planetary shaft 48*a*, attached to disk 54*a* causes disk 54*a* to rotate along with planetary shaft 48*a* at an angular velocity $\omega_2$. As lever 56*a* is attached to disk 54*a* by fixing shaft 58*a*, lever 56*a* rotates with disk 54*a* about axis 32*a*. As disk 54*a* rotates about planetary axis 32*a*, so does moon shaft 60*a* and its moon axis 34*a*.

Planetary sun gear 70*a* is attached to housing 62 and is stationary with respect to disk 52. Idler gear 72*a*, secured to lever 56*a* by shaft 53, is driven about and engages planetary sun gear 70*a*. Idler gear 72*a* thereby rotates about shaft 53*a* in the same direction of rotation as disk 56*a*. Moon spur gear 74*a* is engaged by idler gear 72*a* and moon spur gear 74*a* thereby rotates in the opposite direction as idler gear 72*a* and disc 54*a*, with an angular velocity $\omega_3$ equal in magnitude to $\omega_2$. As spur gear 74*a* is fixedly attached to moon shaft 60*a*, moon shaft 60*a* rotates with moon spur gear 74*a*. Moon member 24*a* rotates along with moon shaft 60*a*.

The gear ratios of sun gear 42, idler gear 44*a* and planetary spur gear 46*a* in this embodiment are chosen so that planetary system 21*a* and hence moon member 24*a* rotates 3 times about planetary axis 32*a* for each rotation of carrier 20 about its axis of rotation 30 (ie. $\omega_3/\omega_1=3$). The gear ratios of planetary sun gear 70*a*, planetary idler gear 72*a* and moon gear 74*a* are chosen so that moon member 24*a* rotates once about moon axis 34*a* for every rotation of sun member 22*a* about planetary axis 32*a*, but in the opposite direction (ie. $\omega_2/\omega_1=-1$)

As moon member 24*a* rotates in a direction opposite the direction of rotation of planetary member 22*a* at the same angular velocity as planetary member 22*a*, pick-up member 24*a* and suction cups 28*a* will always remain generally outwardly facing. Particularly, extension member 40*a* is mounted so that pick-up member 24*a* is always outwardly facing with respect to axis 30.

Figure 2:
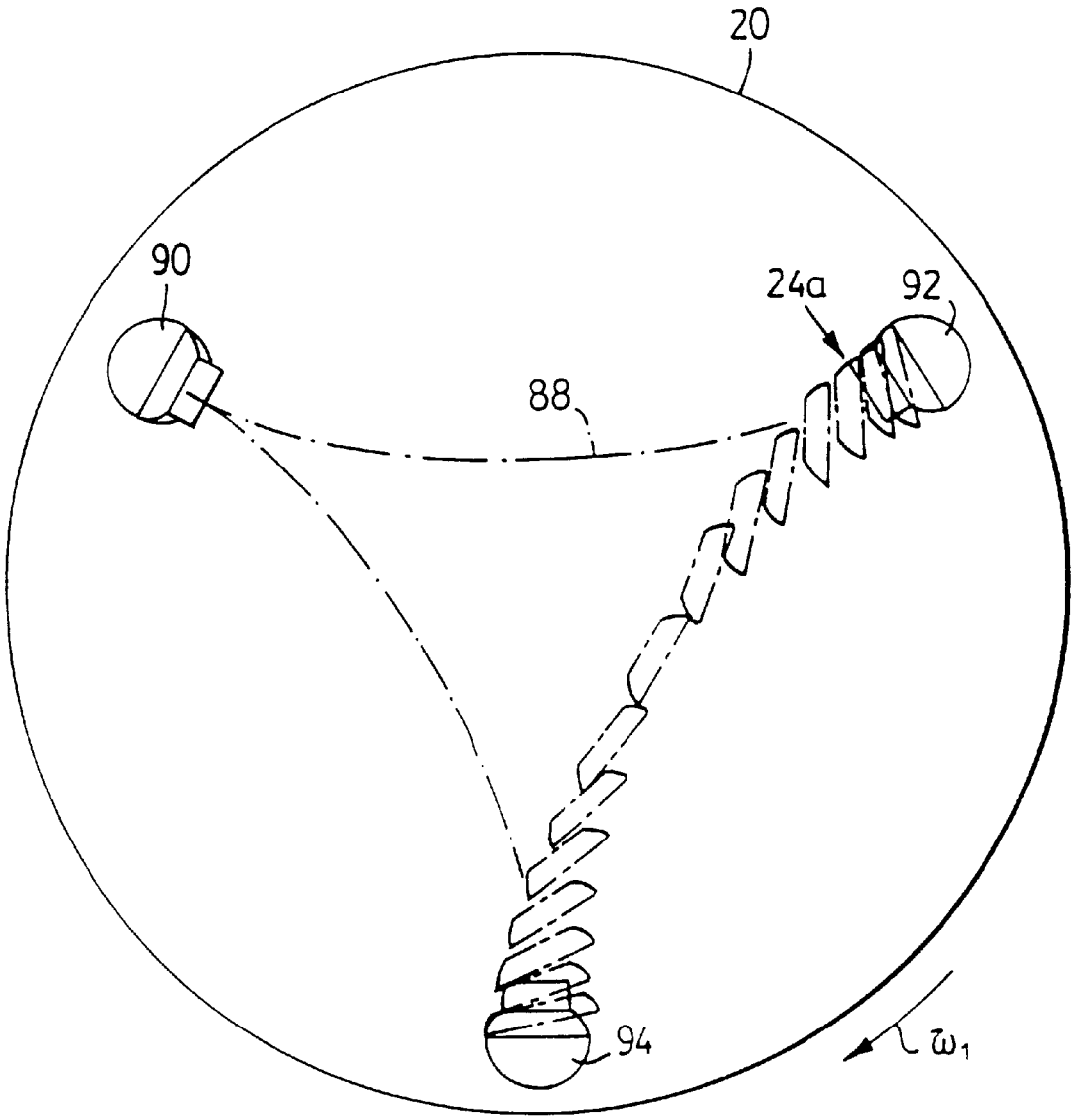
FIG. 2 is a schematic of the embodiment of FIG. 1, in operation.

As carrier member 20 rotates, pick-up member 24*a* traverses a generally triangular trajectory 88 as shown in FIG. 2. At the vertices of this triangular trajectory 88, the velocity of suction cups 28*a* in a direction tangent to the rotation of the carrier is zero. This zero tangential velocity results from the contribution of the rotation of pick-up member 24*a* about axes 34*a*, 32*a* and 30. Zero tangential velocity at the vertices is achieved through a balancing choice of the ratios of rotation of planetary member 22*a* to carrier member 20; the positioning of axes of rotation 34*a*, 32*a* and 30 and the choice of the length of extension member 40*a*, as will be described later in further detail.

Figure 2A:
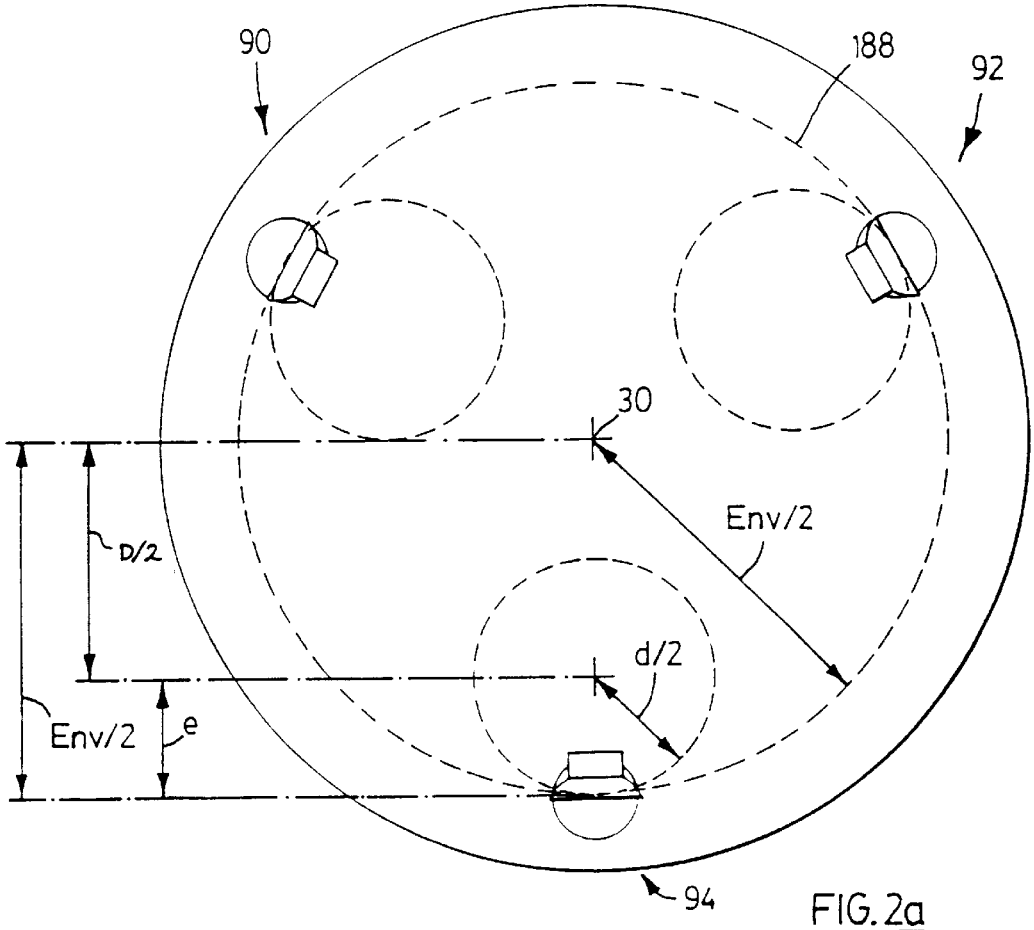
FIG. 2*a* is another schematic of the embodiment of FIG. 1.
Figure 3:
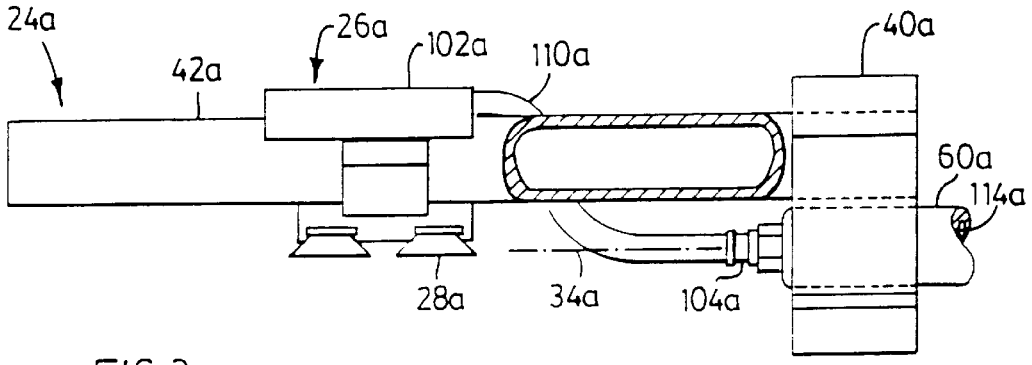
FIG. 3 is a scrap view of a portion of the object featured in FIG. 1, marked as 3 in FIG. 4.

In FIG. 2*a*, the common portion of all three pic-kup members 26*a*, 26*b* and 26*c* is illustrated again, showing how the apparatus is arranged so that each pick up member will reach a vertex at the same instant in time.

Referring again to FIG. 2, as pick-up member 26*a* passes along its triangular trajectory, suction cups 28*a* pass through pick-up location 90. Located at pick-up location 90 is a carton magazine or feeder (not shown) for holding folded cartons. Suction cups 28*a* make contact with a top-most folded carton at pick-up location 90 while travelling in a direction perpendicular to the planar surface of the folded cartons. As pick-up member 24*a* passes through pick-up location 90, or shortly therebefore, an electric control valve (not shown) causes the inlet of vacuum generator 102*a* to be provided with pressurized air.

The electrical control valve is provided with control signals by means of control wires (not shown). These control wires are fixed relative to disc 52 make further contact with control wires 39 through slip ring 37. Control wires 39 are stationery relative to support 16 on the opposite side of slip ring 37. Thus, the control wires are stationary relative to disc 50 and mount 16. A suitable slip ring for use with this invention is sold by Litton™, as part No. AC4598.

The pressurized air is fed to vacuum generator 102*a* via air passages or cavities 126, 116*a*, 114*a* and hoses 118*a* and 112*a*. Vacuum generator 102*a* converts this pressurized air into a constant source of suction. This suction is fed to suction cups 28*a*, thereby causing a carton to adhere to suction cups 28*a* at pick-up location 90. In some applications, it is possible for the vacuum generator to be eliminated and a vacuum applied through the entire air system. The electrical actuator retains pressurized air at vacuum generator 102*a* and thereby suction at suction cup 28 until suction cup 28*a* reaches off-loading location 94. Suction cup 28*a* transports a folded carton from pick-up location 90 along trajectory 88 to operating location 92. As the folded carton travels from pick-up location 90, suction cup 28 remains outwardly facing because of suction cup 28*a*'s rotation in an opposite direction and at an angular velocity equal to that of planetary member 22*a*.

As the shaft 36 and manifold 124 rotate, the distance between axis 32*a* and axis 30 does not change. Thus the distance between a nib on the manifold and its corresponding, connecting nibs on a planetary member does not change.

As connector 117*a* is attached by swivel joint 121*a* to swivel about axis 32*a*, hose 118*a* does not become twisted as manifold 124 rotates.

The same principle applies in respect of hose 112*a* between nib 108*a* and connector 106*a*, the latter which is adapted to swivel about axis 34*a* by means of swivel joint 122*a*, and in respect of hose 110*a* which links vacuum generator 102*a* to nib 104*a*. Nib 104*a* need not rotate about axis 34*a* because there is no movement of shaft 42*a* relative to shaft 60*a*.

Located at operating location 92 is an expansion unit (not shown). At operating location 92, the folded carton has zero tangential velocity. The carton expander, is located tangent to carrier 20 at operating location 92. The expander engages the folded carton and pulls the carton apart in a direction radial to carrier 20. Suction cup 28*a* further transports the unfolded carton along trajectory 88 to off-loading location 94. At off-loading location 94 the electromechanical actuator releases the negative pressure at suction cups 28*a*. Accordingly, the unfolded carton, having zero tangential velocity at off-loading location 94 is released. Located at off-loading location 94 is a transport mechanism (not shown) on which the unfolded carton is released. The unfolded carton is then transported by the transport mechanism away from the carton feeder to a location (not shown) where the carton is further processed.

Pick-up location 90, operating location 92 and off-loading location 94 are equally spaced from each other along the periphery of carrier 20. While pick-up member 26*a* follows trajectory 88, pick-up member 26*c* follows the same trajectory, but lags by 120° of rotation of carrier 20. Similarly, pick-up member 26*c* further lags 120° behind pick-up member 24*b*. Thus, when pick-up member 26*a* passes through pick-up location 90, pick-up member 24*c* passes through off-loading location 94, and pick-up member 24*b* passes through operating location 92. Vacuum generators 102*b* and 102*c* are actuated as pick-up members 26*b* and 26*c* pass through pick-up location 90. They are released as pick-up members 26*b* and 26*c* pass through off-loading location 94. Thus, for each rotation of carrier 20 about axis 30, three folded cartons are picked-up at pick-up location 90, expanded at operating location 92 and released at off-loading location 94.

Embodiment 2

Figure 9:
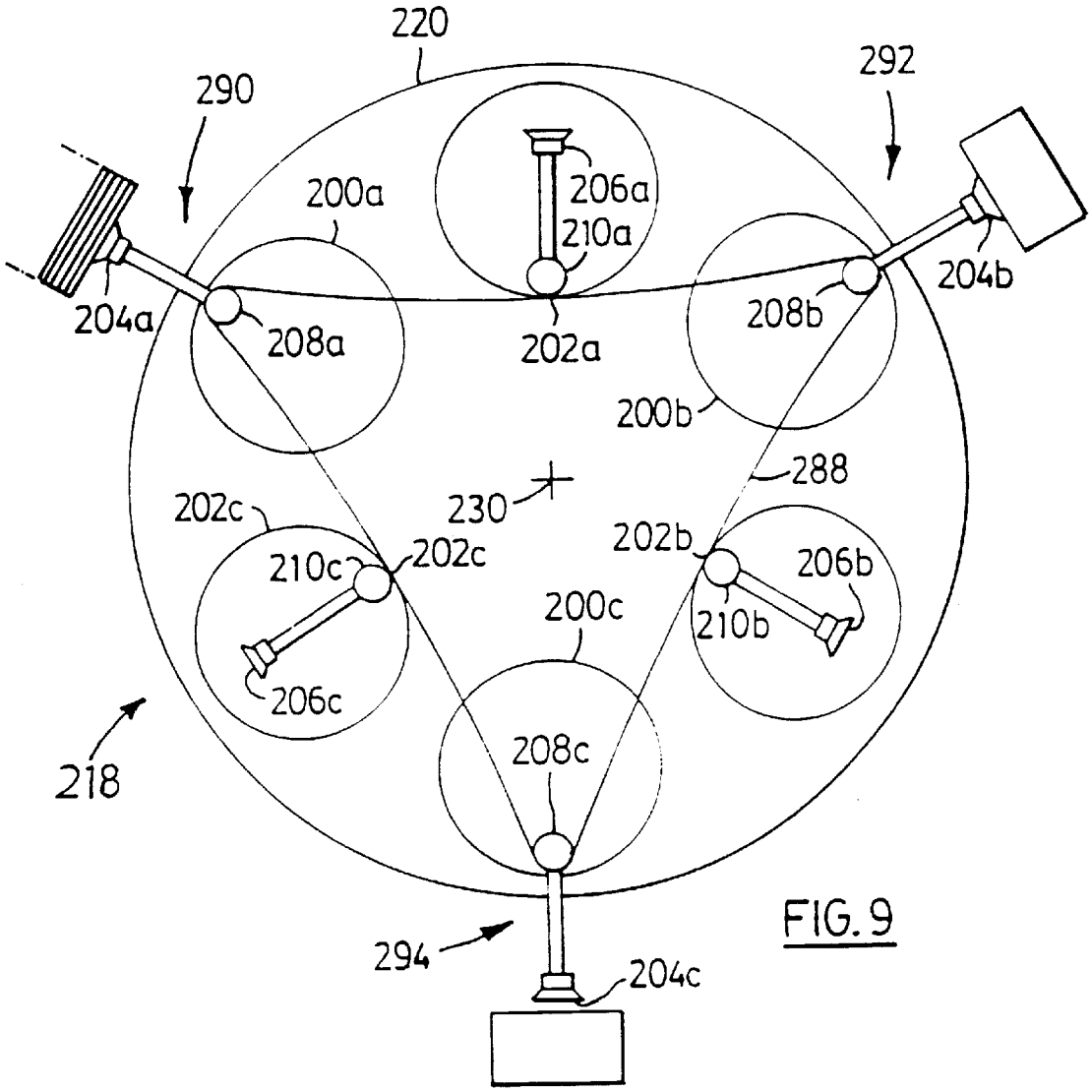
FIG. 9 is a schematic view of another object feeder having six pick-up heads in accordance with another embodiment of the present invention in operation.

With reference to FIG. 9, there is provided a rotary object feeder generally designated 218 having two sets of three identical planetary members; a first set 200*a*, 200*b*, 200*c*; and a second set 202*a*, 202*b*, and 202*c*.

The size of planetary members 200, 202 and the carrier member 220 are chosen, so that two sets of three planetary members may be mounted on a single carrier member.

In this embodiment, the six planetary members are arranged to function as two sets of three planetary members. The first set comprising planetary member 200*a*, 200*b*, and 200*c* having moon members 210*a*, 210*b* and 210*c* mounted thereon. Each moon member further comprises a pick-up member 206*a*, 206*b* and 206*c*. Each moon member 208*a*, 208*b* and 208*c* and 210*a*, 210*b*, 210*c* travels along trajectory 288 generally in the triangular pattern illustrated.

Each of the sets of moon members 208 and 210 rotate three times about a planetary axes for each rotation of carrier 220 about a sun axis, in an opposite direction as carrier 220. The pick-up members 204, travel along the trajectory 288 but lag pick-up members 206, by 60° of rotation of carrier member 220 about sun axis 230.

The vertices of the trajectory 288 are located at positions, 290, 292 and 294. Each of the pick-up members 204 and 206 pass through each vertex once for every rotation of carrier 220. Located at these vertices are a folded carton feeder, an operating unit and a transport unit respectively, as with the embodiment 1 shown in FIGS. 1–6. As in Embodiment 1 of FIGS. 1–6, a vacuum generator on each of members 204, and 206 is actuated as each of the pick-up members passes through the pick-up location 290. Suction cups forming pick-up members 204 and 206 pick-up a folded carton at pick-up location 290, transport it to operating location 292 where the folded carton is expanded, transport it to a further off-loading location 294 where it is released.

With the proper choice of angular velocities, position of axes and the proper mounting of the pick-up members, each suction cup will pass through pick-up 290, operating 292 and off-loading location 294 with zero tangential velocity.

Embodiment 3

Figure 10:
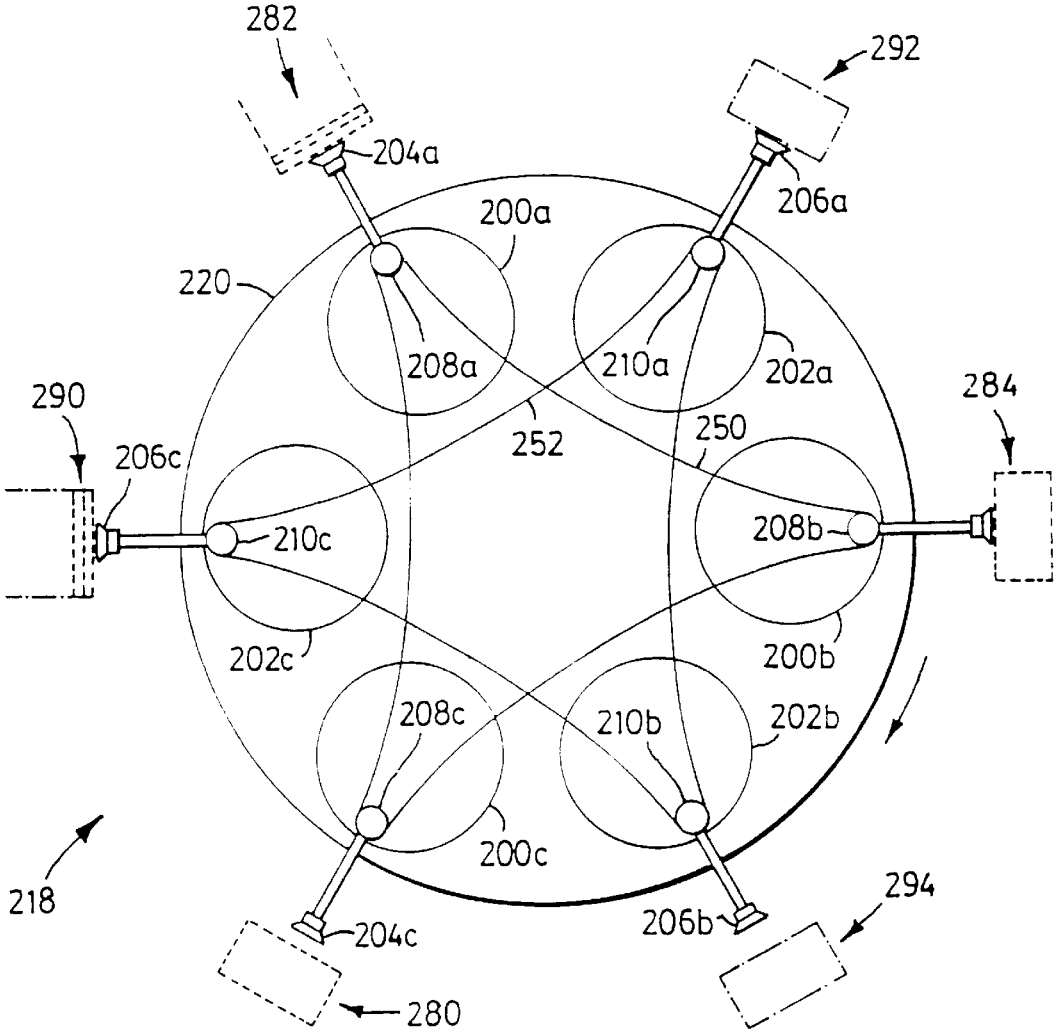
FIG. 10 is a schematic view of another object feeder having six pick-up heads in accordance with another embodiment of the present invention.

It is possible that the general concept of the invention may be adapted to allow several pick-up members to each follow a different trajectory. In FIG. 10, each set of three pick-up members follow a different trajectory. Accordingly, in operation one set of pick-up members 200*a*, 200*b*, 200*c* follows a hypocycloidal trajectory. A second set of pick-up members 202*a*, 202*b* and 202*c* follows a hypocycloidal trajectory. The vertices of each trajectory are at different locations relative to the frame support (not shown). A rotary feeder according to such an embodiment may be adapted for two pick-up locations 280, 290, two operating locations 282, 292 and two off-loading locations 284, 294. Moon members 208*a* 208*b*, 208*c* and 210*a*, 210*b*, 210*c* follow paths 250 and 252, respectively. Each set of pick-up members 200 and 202 will pass along a generally hypocycloidal trajectory having one of the pick-up locations 280 or 290; one of the operating locations 282 or 292 and one of the off-loading locations 284 or 294 at its vertices. The rotary feeder may be used to feed six folded cartons from two different pick-up locations to two different off-loading locations for each rotation of carrier member 220.

Embodiment 4

Figure 11:
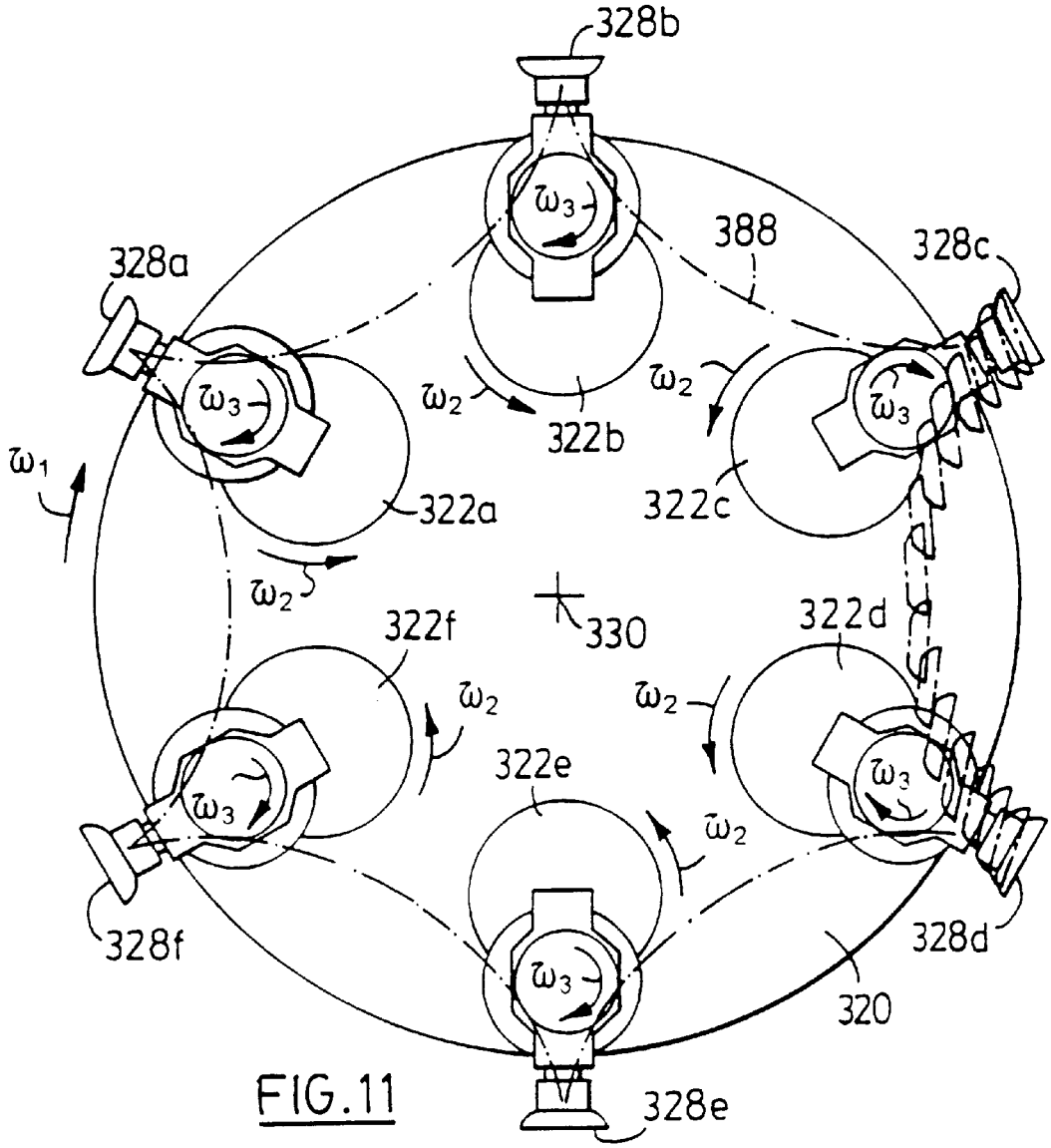
FIG. 11 is a schematic of the embodiment of FIG. 7, in operation.
Figure 11A:
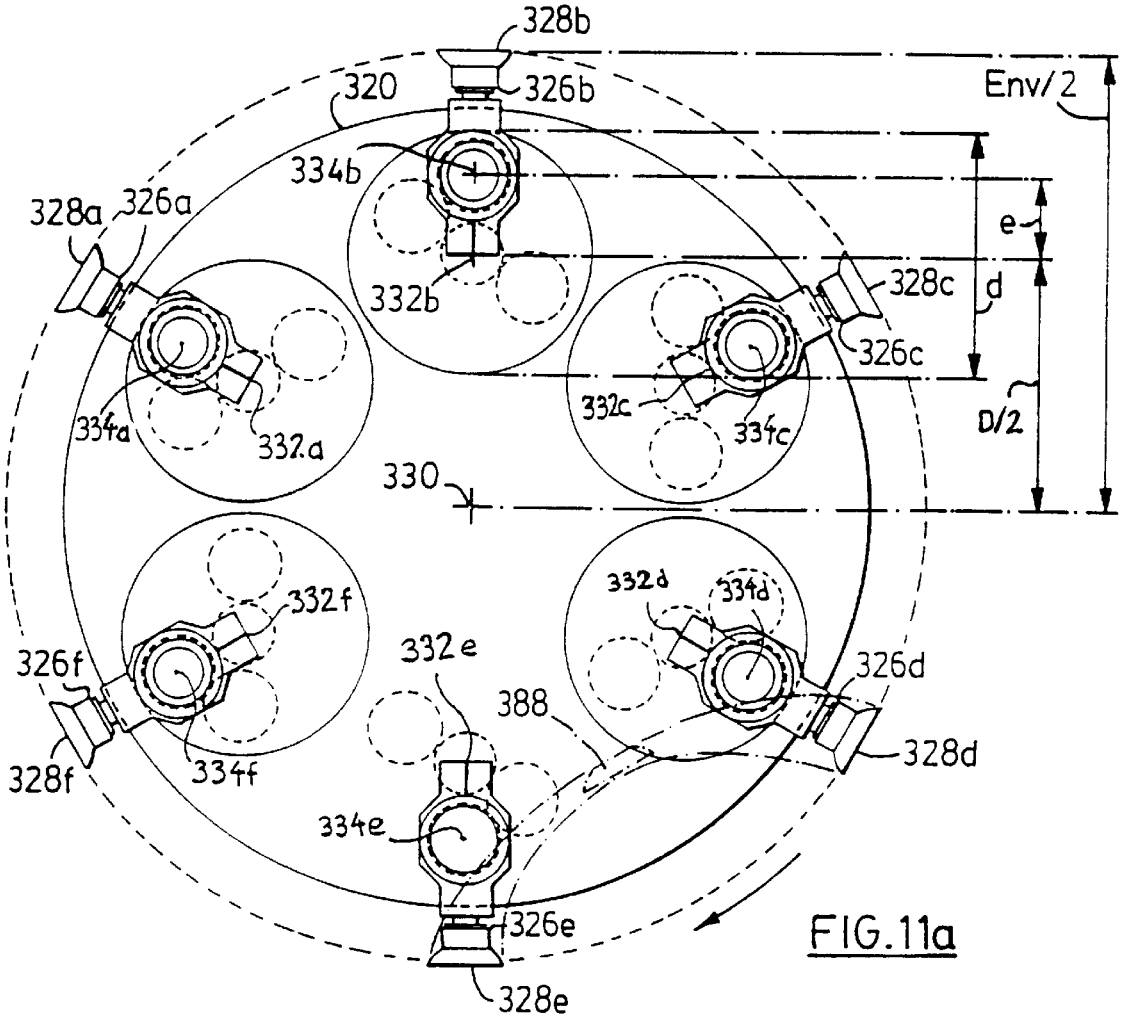
FIG. 11*a* is a schematic view of the object feeder of FIGS. 7 and 11.

The general inventive concept of the present invention, is not limited to rotary feeders having pick-up members rotating at three times the rate of a carrier member. FIGS. 7, 8, 11 and 11*a*, for example, illustrate a rotary object feeder having six pick-up members. In this embodiment, each planetary member 322*a*–322*f* is geared so that it rotates six times about planetary axes 332*a*–332*f* for each rotation of carrier member 320 about sun axis 330. The trajectory 388 of each planetary member is accordingly pseudo-hexagonal with six vertices, as shown in FIGS. 11 and 11*a*. As the relative radii and rates of rotation of carrier member 320 to planetary members 322*a*–322*f*, differs from the Embodiments 1, 2 and 3, the length of mounting shafts 326*a*–326*f* are chosen to achieve a minimum velocity of pick-up members 328*a*–328*f* at these vertices. Accordingly, the carton feeder may be adapted to have two sets of pick-up, operating, and off-loading locations, or it may be adapted to have a single pick-up and off-loading position with four operating positions, depending on the requirements of the particular application.

Figure 7:
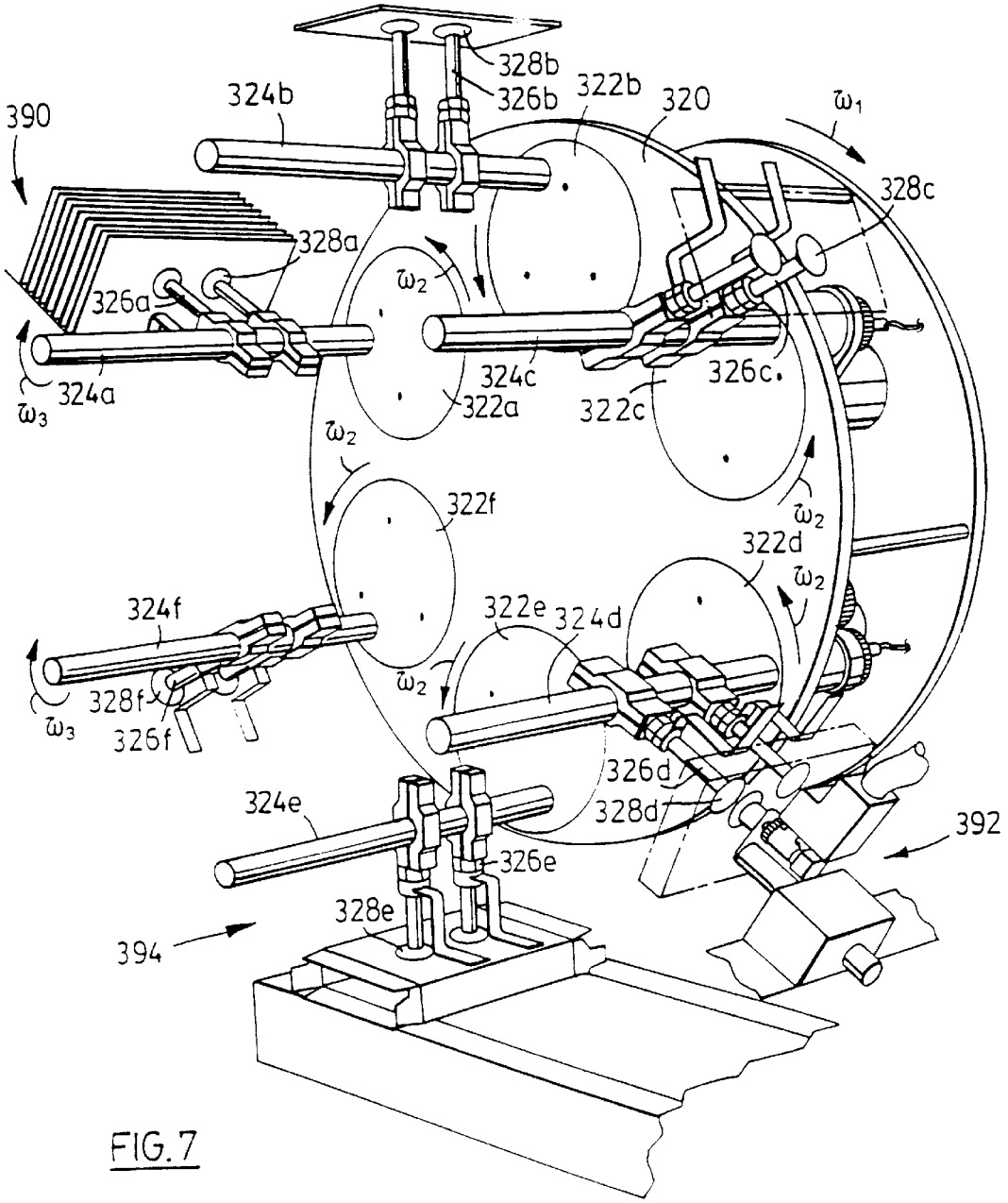
FIG. 7 is a perspective view of an object feeder having six pick-up heads in accordance with another embodiment of the present invention.

In the embodiment illustrated in FIG. 7, each object pick-up member will pick-up a folded carton from a magazine at a loading station 390. The folded carton is then rotated about the path shown in FIGS. 11 and 11*a* to a carton erection station 392. At station 392 a conventional carton erection apparatus is located, such as a vacuum source mounted on a reciprocating arm. The motion of the pick-up member may be such as to obviate the necessity for a separate reciprocating arm. Once the carton has been erected the carton is rotated to an unloading station where the vacuum at the suction cups in turned off, and the carton is allowed to be deposited onto a conveyor which removes the carton from the station. If the carton is stationary at the station 394, this carton feeder will be particularly suitable for use in combination with a hesitating carton loading system such as that disclosed in U.S. Pat. No. 5,371,995 issued Dec. 13, 1994 to Guttinger et al.

Figure 8:
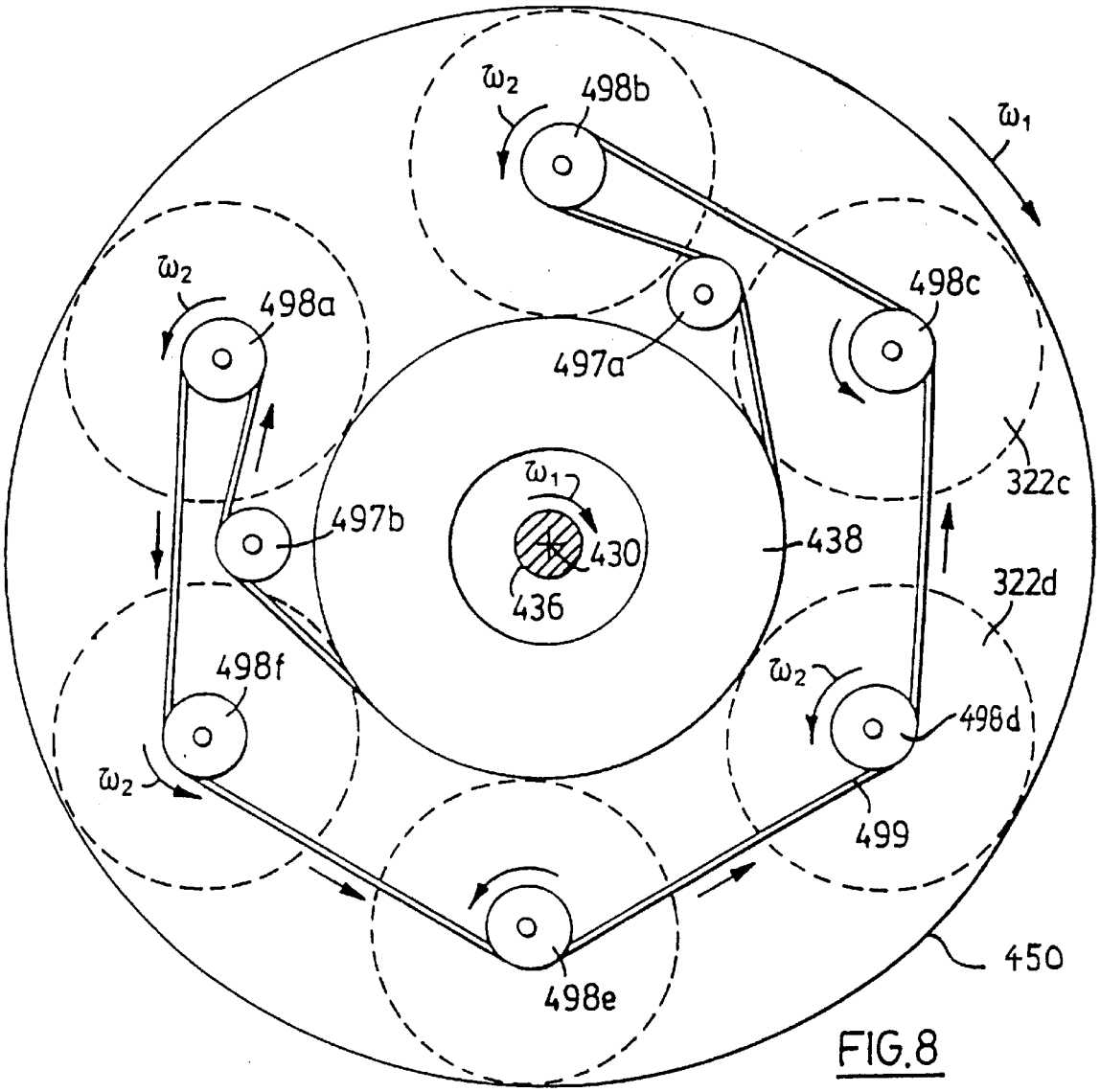
FIG. 8 is a plan view of the rear of the object feeder of FIG. 7.

In FIG. 8 an alternate drive mechanism to the gearing mechanism described above, is shown for the planetary members in a 6 pick-up member rotary system. A sunwheel 438 is fixedly mounted to a support frame (not shown). Sunwheel 438 has mounted along its periphery a number of gear teeth. Disk 450 is mounted to shaft 436, and rotates relative to sunwheel 438. Gears 498 are rotatably mounted on one side of disk 450, and are connected to planetary members 322. Planetary members 322 are mounted on an opposite side of disk 450. A chain 499 is mounted about sunwheel 438, gears 498 and idler gears 497. In operation, shaft 436 is driven by a source of rotational power. Disk 450 rotates relative to sunwheel 438. Chain 499 travels along the periphery of sunwheel 438 and engages the gear teeth of sunwheel 438, and thereby moves relative to sunwheel 438. This motion of the chain, thus causes idler gears 497 and gears 498 to rotate. As gears 498 rotate, so do planetary members 322.

Various other types of driving mechanisms for rotary systems within the scope of the present invention are possible.

The Mathematical Assumptions

In each of the above embodiments the tangential velocity of each object-pick up member will be at or approach zero at the vertices of its trajectory. This is achieved through selection of a specific arrangement of mounting distances for planetary axis; moon axis; and pick-up member relative to a sun axis, and relative rates of rotation of carrier; planetary member and moon member. This selection may be even more clearly understood by reference to the following mathematical equations which are valid for the above embodiments:

Where, $E_{nv}/2$=distance from the sun axis 30/330 to the circumferential arc created by the pick up point (eg.suction cup) of the pick-up member 28*a* when positioned at the vertices of its trajectory;

D/2=distance from the sun axis 30/330 to the planetary axis 32*a*/332*a;* e=the distance from the planetary axes 32*a*/332*a* to the moon axes 34*a*/334*a;*

Figure 4:
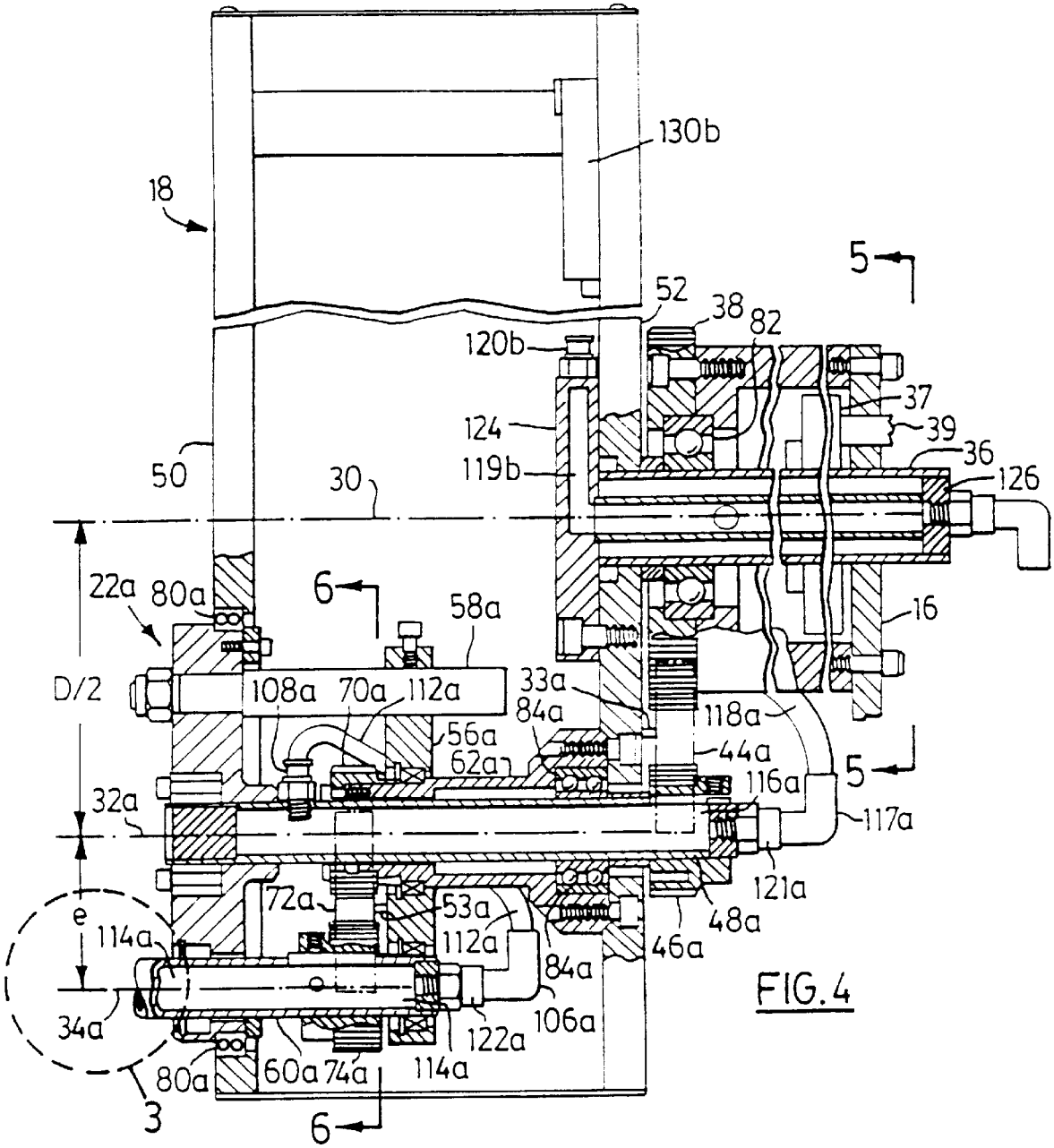
FIG. 4 is a cross sectional view from the side, of part of the object feeder of FIG. 1.
Figure 4A:
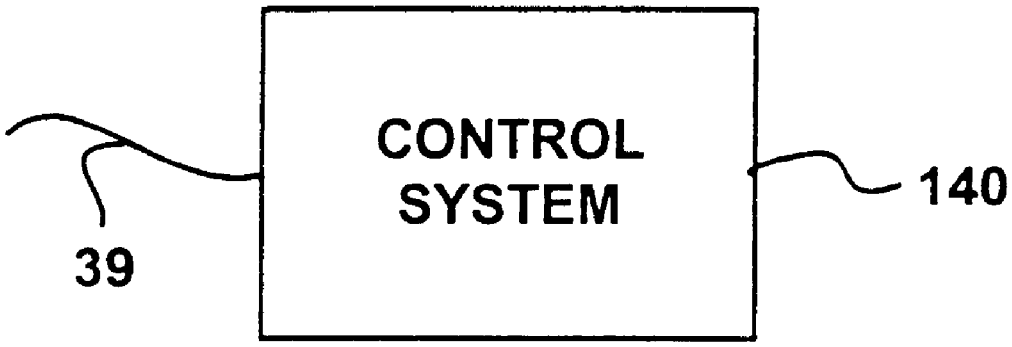
FIG. 4*a* is a schematic view of a computer control system used as part of the object feeder of FIG. 1.

$V_t$=tangential velocity at a vertex of the path of the pick-up member;

The physical significance of these variables is shown is FIGS. 4 and 11.

The tangential velocity of the pick up point of a pick-up member $V_t$ at a vertex of the path is calculated as follows:

$$V_t=(E_{nv}\times\omega_1)/2+\{((E_{nv}-D)\times\omega_2/2)+(((E_{nv}-D)/2-e)\times\omega_3)\}$$

In order to obtain a minimal tangential velocity of pick-up member 28*a* at these vertices, $E_{nv}$, D, e, $\omega_1$, $\omega_2$ and $\omega_3$ must be chosen such that $V_t=0$ in the above equation.

Thus, in Embodiment 1 (see FIG. 2*a*):

Setting $V_t=0$; and choosing $\omega_2=-3\omega_1$, and $\omega_2=-\omega_3$ yields $e=E_{nv}/6$ In Embodiment 4 (see FIG. 11*a*):

Setting $V_t=0$; and choosing $\omega_2=-6\omega_1$, and $\omega_2=-\omega_3$ $e=E_{nv}/12$ In both embodiments, D may be calculated by noting:

$D=E_{nv}-2e$

It will be understood by a person skilled in the art that many different variations are possible. Depending on the choice of sizes of the carrier and the planetary members, it is possible to construct a rotary feeder with an arbitrary number of carrier members. These carrier members may be adapted to rotate at any rate. By choosing the proper length of mounting shafts and/or extension members it is possible to balance the rotary feeder so that these pick-up members reach a minimum tangential velocity at the vertices of their trajectory(ies).

It will be further understood that the invention is not limited to the illustrations described and shown herein, which are deemed to be merely illustrative of the best modes of carrying out the invention, and which are susceptible to modification of form, size, arrangement of parts and details of operation. The invention, rather, is intended to encompass all such modifications which are within its spirit and scope as defined by the claims.

We claim:

1. A rotary object feeder, comprising:

a support;

a carrier member rotatably mounted to said support at a sun axis of rotation for rotation at a constant angular velocity $\omega_1$ about said sun axis;

a planetary member rotatably mounted to said carrier member at a planetary axis of rotation spaced from said sun axis of rotation at a distance D/2, said planetary member mounted for rotation at a constant planetary angular velocity $\omega_2$ about said planetary axis;

a moon member rotatably mounted to said planetary member at a moon axis of rotation spaced from said planetary axis of rotation at a distance e, said moon member mounted for rotation at a constant moon angular velocity $\omega_3$ about said moon axis;

an object pick-up member mounted to said moon member, having a pick-up surface at an outermost distance $E_{nv}/2$ from said sun axis;

said sun axis of rotation, said planetary axis of rotation and said moon axis of rotation being substantially parallel; and wherein $(E_{nv}\times\omega_1)/2+\{((E_{nv}-D)\times\omega_2/2)+(((E_{nv}-D)/2-e)\times\omega_3)\}$ substantially equals zero.

2. The rotary object feeder of claim 1, further comprising a motor operably interconnected with said carrier member to rotate said carrier member, said planetary member and said moon member.

3. The rotary object feeder of claim 2, wherein $(E_{nv}\times\omega_1)/2+\{((E_{nv}-D)\times\omega_2/2)+(((E_{nv}-D)/2-e)\times\omega_3)\}$ equals zero.

4. A rotary object feeder, comprising:

a support;

a carrier member rotatably mounted to said support at a sun axis of rotation;

a planetary member rotatably mounted to said carrier member at a planetary axis of rotation spaced from said sun axis of rotation at a distance D/2;

a moon member rotatably mounted to said planetary member at a moon axis of rotation spaced from said planetary axis of rotation at a distance e;

an object pick-up member mounted to said moon member, having a pick-up surface at an outermost distance $E_{nv}/2$ from said sun axis;

said sun axis of rotation, said planetary axis of rotation and said moon axis of rotation being substantially parallel;

means for continuously rotating said carrier member at a constant carrier angular velocity $\omega_1$, said planetary member at a constant planetary angular velocity $\omega_2$, and said moon member at a constant moon angular velocity $\omega_3$, wherein $(E_{nv}\times\omega_1)/2+\{((E_{nv}-D)\times\omega_2/2)+(((E_{nv}-D)/2-e)\times\omega_3)\}$ substantially equals zero.

5. The feeder of claim 4 wherein said means for rotating is arranged to rotate said planetary member in a direction opposite a direction of rotation of said sun member and said moon member.

6. The feeder of claim 5, wherein said means for rotating is arranged such that $\omega_1:\omega_2=-1$ and $\omega_1:\omega_3=-1$.

7. The feeder of claim 6 wherein said means for rotating comprises a drive train.

8. The feeder of claim 7 wherein said means for rotating is arranged to move said pick-up member through an operating location between said pick-up location and said off-loading location at a reduced velocity.

9. The feeder of claim 4 wherein said means for rotating is arranged such that said moon member angular velocity, $\omega_3$ is equal in magnitude to said planetary member angular velocity, $\omega_2$ and said planetary member angular velocity, $\omega_2$ and said moon member angular velocity are an integer multiple of said carrier member angular velocity, $\omega_1$.

10. The feeder of claim 9 wherein said pick-up member comprises a suction cup.

11. The feeder of claim 10 further comprising electrical control means to actuate said pick-up member to pick up said object at said pick-up location and to release said object at said off-loading location.

12. The feeder of claim 11 wherein said means for rotating comprises a motor and wherein said drive train comprises gearing operably connected between said motor and said carrier member, said planetary member and said moon member.

13. The feeder of claim 12 further comprising a storage cartridge for holding folded cartons at said pick-up location;

means to erect said folded cartons located at said operating location;

a transport apparatus for transporting said cartons away from said feeder at said off-loading location;

wherein said pick-up member picks up a folded carton from said storage cartridge, said means to erect said folded cartons unfolds and erects said folded carton at said operating location and then said erected carton is transported to and then released at said off-loading location by said pick-up member.

14. The feeder of claim 4 wherein said pick-up member comprises a suction cup and said feeder further comprises an actuatable vacuum generator, said vacuum generator comprises an air input and an air output, said output in fluid communication with said suction cup, said generator for converting a source of positive air pressure supplied to said input to a vacuum at said output to provide a source of vacuum for said suction cup.

15. The feeder of claim 14 wherein:

said moon member has a hollow moon shaft with first and second ends, said hollow moon shaft having an elongated cavity, a first opening, and a second opening, said moon shaft having air communication through said elongated cavity between said first and second openings, said moon shaft positioned coaxially with said moon axis;

said planetary member has a hollow planetary shaft with first and second ends, said hollow planetary shaft having an elongated cavity with a first opening and a second opening, said planetary shaft having air communication through said cavity between said first and second openings of said cavity in said planetary shaft, said planetary shaft positioned coaxially with said planetary axis;

said carrier member being mounted on a hollow main shaft with a first end and a second end, said hollow main shaft having an elongated cavity with a first opening and a second opening, said shaft having air communication through said cavity between said first and second openings of said cavity of said main shaft, said main shaft being positioned coaxially with said sun axis;

and wherein said source of air pressure supplied to said vacuum generator comprises:

a first air pipe means connecting said vacuum generator to said first opening of said moon shaft;

a second air pipe means connecting said second opening of said moon shaft to said first opening of said planetary shaft, said second air pipe means having at least one swivel connection to permit said second air pipe means to swivel about at least one of said moon axis or said planetary axis;

a third air pipe means connecting said second opening of said planetary shaft to said first opening of said main shaft, said third air pipe means having at least one swivel connection to permit said third air pipe means to swivel about at least one of said planetary axis or said sun axis;

a source of air pressure connected to said second opening of said main shaft;

a control valve for controlling the vacuum for said suction cup.

16. A feeder as claimed in claim 15 wherein said first opening and said second opening of said cavity in said moon member are respectively positioned proximate said first and second ends of said moon member and said first opening and said second opening of said cavity in said planetary member are respectively positioned proximate said first and second ends of said planetary member.

17. The feeder of claim 4 wherein:

said pick-up member has a suction cup;

said moon member has a hollow moon shaft with first and second ends, said hollow moon shaft having an elongated cavity with a first opening and a second opening, said moon shaft having air communication through said cavity between said first and second openings of said cavity of said moon shaft, said moon shaft positioned coaxially with said moon axis;

said planetary member has a hollow planetary shaft with first and second ends, said planetary shaft having an elongated cavity with a first opening and a second opening, said shaft having air communication through said cavity between said first and second openings of said cavity of said planetary member, said planetary shaft positioned coaxially with said planetary axis;

said carrier member is mounted on a hollow main shaft with a first end and a second end, said main shaft having an elongated cavity with a first opening and a second opening, said main shaft having air communication through said cavity between said first and second openings of said cavity of said main shaft, said main shaft positioned coaxially with said sun axis;

an air communication system comprising:

a first air communication means connecting said suction cup and said first opening of said moon shaft;

a second air communication means connecting said second opening of said moon shaft to said first opening of said planetary shaft;

a third air communication means connecting said second opening of said planetary shaft to said first opening of said main shaft;

whereby a supply of air may be applied at said second opening of said main shaft to pass a supply of air through said air communication means and said cavities in said moon shaft, said planetary shaft and said main shaft to provide a vacuum at said suction cup.

18. The feeder of claim 17, further comprising a vacuum generator for converting a source of positive air pressure to a vacuum, disposed within said air communication system, such that if a supply of positively pressurized air is applied at said second opening of said main shaft, a vacuum is generated at said suction cup.

19. A feeder as claimed in claim 18 wherein said vacuum generator is included in said first air communication means.

20. A feeder as claimed in claim 17 wherein said first opening and said second opening of said cavity in said moon member are respectively positioned proximate said first and second ends of said moon member and said first opening and said second opening of said cavity in said planetary member are respectively positioned proximate said first and second ends of said planetary member.

21. A rotary object feeder, comprising:

a support;

a carrier member rotatably mounted to said support at a sun axis of rotation;

a planetary member rotatably mounted to said carrier member at a planetary axis of rotation spaced from said sun axis of rotation at a distance D/2;

a moon member rotatably mounted to said planetary member at a moon axis of rotation spaced from said planetary axis of rotation at a distance e;

an object pick-up member mounted to said moon member, having a pick-up surface at an outermost distance $E_{nv}/2$ from said sun axis;

said sun axis of rotation, said planetary axis of rotation and said moon axis of rotation being substantially parallel;

means for continuously rotating said carrier member at a constant carrier angular velocity $\omega_1$, said planetary member at a constant planetary angular velocity $\omega_2$, and said moon member at a constant moon angular velocity $\omega_3$, wherein $E_{nv}$, D and e are chosen so that $(E_{nv}\times\omega_1)/2+\{((E_{nv}-D)\times\omega_2/2)+((E_{nv}-D)/2-e)\times\omega_3)\}$ substantially equals zero.

22. A rotary object feeder comprising a support;

a carrier member, rotatably mounted to said support at a sun axis of rotation;

a planetary member, rotatably mounted to said carrier member at a planetary axis of rotation, said planetary axis parallel to said sun axis and spaced therefrom;

an extension member rotatably mounted to said planetary member at a moon axis of rotation, said moon axis parallel to said planetary axis and spaced therefrom, said extension member mounted for rotation about said moon axis, and extending radially from said moon axis;

a shaft extending away from said extension member in a direction generally parallel to said moon axis and spaced from said moon axis; and an object pick-up member mounted to said shaft having a pick-up surface for selective pick-up and release of objects proximate a periphery of said feeder, said pick-up surface extending toward said moor axis as said pick-up member picks-up and releases objects.

23. The rotary feeder of claim 22, further comprising a motor operably interconnected with said carrier member to rotate said carrier member, said planetary member and said extension member.

24. The rotary feeder of claim 23, wherein said planetary axis is spaced from said sun axis a distance of D/2;

said moon axis is spaced from said planetary axis a distance of e;

said pick-up surface is spaced from said sun axis at a distance $E_{nv}/2$;

said carrier member, said planetary member and said moon member are adapted to rotate at rates of rotation $\omega_1$, $\omega_2$, and $\omega_3$ about said sun, planetary and moon axes, respectively; and wherein $(E_{nv}\times\omega_1)/2+\{((E_{nv}-D)\times\omega_2/2)+(((E_{nv}-D)/2-e)\times\omega_3)\}$ substantially equals zero.

25. The rotary feeder of claim 22, wherein said object pick-up member is fixedly mounted to said shaft.

26. The rotary object feeder of claim 22 wherein three substantially identical planetary members arc rotatably mounted to said carrier member at equal angular spacings about said sun axis, each planetary member is associated with an extension member rotatably mounted to an associated planetary member at an associated moon axis and extending radially therefrom, each moon axis generally parallel to said sun axis, each extension member is associated with a shaft extending from an associated extension member, in a direction generally parallel to an associated moon axis and spaced therefrom, each shaft is associated with an object pick-up member mounted to an associated shaft, each pick-up member has a pick-up surface for selective pick-up and release of objects proximate a periphery of said feeder, and each pick-up member extends toward an associated moon axis as said each pick-up member picks-up and releases objects.

27. A rotary object feeder comprising a support;

a carrier member, rotatably mounted to said support at a sun axis of rotation;

a planetary member, rotatably mounted to said carrier member at a planetary axis of rotation, said planetary axis parallel to said sun axis and spaced therefrom;

an extension member rotatably mounted to said planetary member at a moon axis of rotation, said moon axis parallel to said planetary axis and spaced therefrom, said extension member mounted for rotation about said moon axis, and extending radially from said moon axis;

a shaft extending away from said extension member in a direction generally parallel to said moon axis and spaced from said moon axis; and an object pick up member mounted to said shaft having a pick-up surface extending toward said moon axis for selective pick-up and release of objects proximate a periphery of said feeder at a distance less than or equal to the distance of said moon axis from said sun axis.

28. The rotary feeder of claim 27, further comprising a motor operably interconnected with said carrier member to rotate said carrier member, said planetary member and said extension member.

29. The rotary feeder of claim 28, wherein said planetary axis is spaced from said sun axis a distance of D/2;

said moon axis is spaced from said planetary axis a distance of e;

said pick-up surface is spaced from said sun axis at a distance $E_{nv}/2$;

said carrier member, said planetary member and said moon member are adapted to rotate at rates of rotation $\omega_1$, $\omega_2$, and $\omega_3$ about said sun, planetary and moon axes, respectively; and wherein $(E_{nv}\times\omega_1)/2+\{((E_{nv}-D)\times\omega_2/2)+(((E_{nv}-D)/2-e)\times\omega_3)\}$ substantially equals zero.

30. The rotary feeder of claim 27, wherein said object pick-up member is fixedly mounted to said shaft.

31. The rotary object feeder of claim 27, wherein a total of three substantially identical planetary members, are rotatably mounted to said carrier member at substantially equal angular spacings about said sun axis, each planetary member is associated with an extension member rotatably mounted to an associated planetary member at an associated moon axis and extending radially therefrom, each moon axis generally parallel to said sun axis, each extension member is associated with a shaft extending from an associated extension member, in a direction generally parallel to an associated moon axis and spaced therefrom, each shaft is associated with an object pick-up member mounted to an associated shaft, each pick-up member has a pick-up surface for selective pick-up and release of objects proximate a periphery of said feeder, and each pick-up member extends toward an associated moon axis as said each pick-up member picks-up and releases objects.

32. A rotary object feeder, comprising:

(a) a support;

(b) a carrier member rotatably mounted to said support at a sun axis of rotation;

(c) first and second planetary systems, each planetary system comprising:

(i) a planetary member rotatably mounted to said carrier member at a planetary axis of rotation spaced from said sun axis of rotation;

(ii) a moon member rotatably mounted to said planetary member at a moon axis of rotation spaced from said planetary axis of rotation;

(iii) an object pick-up member mounted to said moon member;

said sun axis of rotation, and said planetary axes of rotation and said moon axes of rotation being substantially parallel;

means for continuously rotating said carrier member, said planetary members, and said moon members at fixed relative angular velocities, with at least one of said planetary member and said moon member in each planetary system rotating in a direction opposite to that of said carrier member, such that each of said pick-up members moves through a pick-up location at a reduced velocity relative to said support, wherein a moon member, planetary member and object pick-up member of said first planetary system and a moon member, planetary member and object pick-up member of said second planetary system are mounted to said carrier member so that said object pick-up member of said first system travels along a first path about said sun axis, and said object pick-up member of said second planetary system travels along a second path about said sun axis, different than said first path.

33. A feeder as claimed in claim 32 wherein the angular velocities of said moon member and said planetary member of said first planetary system are the same as the respective angular velocities of said moon member and said planetary member of said second planetary system.

34. A feeder as claimed in claim 33, wherein the angular position of said moon member of said first planetary system is in phase with the angular position of said moon member of said second planetary system.

35. A feeder as claimed in claim 33 wherein said means for rotating is arranged to rotate said moon member of said first planetary system at a first moon member angular velocity and said planetary member of said first planetary system at a first planetary member angular velocity, and said moon member of said second planetary system at a second moon member angular velocity and said planetary member of said second planetary system at a second planetary member angular velocity, with said first moon member angular velocity being equal in magnitude to said first planetary member angular velocity, and said second moon member angular velocity being equal in magnitude to said second planetary member angular velocity, said first planetary member angular velocity being a first integer multiple of the carrier member angular velocity and said second planetary member angular velocity being a second integer multiple of the carrier member angular velocity.

36. A feeder as claimed in claim 35 wherein said first integer multiple and said second integer multiple are the same.

37. A rotary object feeder comprising a support;

a carrier member, rotatably mounted to said support at a sun axis of rotation;

three planetary members, rotatably mounted to said carrier member at associated planetary axes of rotation, each planetary axis parallel to said sun axis and spaced therefrom;

an associated extension member rotatably mounted to each planetary member at an associated moon axis of rotation, each moon axis parallel to an associated planetary axis and spaced therefrom, each associated extension member mounted for rotation about an associated moon axis, and extending radially from an associated moon axis;

an associated shaft extending away from an associated extension member in a direction generally parallel to an associated moon axis and spaced therefrom; and an object pick-up member mounted to each associated shaft having a pick-up surface for selective pick-up and release of objects proximate a periphery of said feeder, said pick-up surface extending toward said associated moon axis as said pick-up member picks-up and releases objects.

38. A method for feeding an object from a pick-up location to an off-loading location, comprising the steps of:

moving an object pick-up member having a pick-up surface along a trajectory by (a) rotating said object pick-up member about a first axis of rotation at a constant object pick-up member angular velocity, $\omega_3$;

(b) rotating said first axis of rotation at a constant angular velocity $\omega_2$ about a second axis of rotation substantially parallel to said first axis of rotation and spaced a distance e therefrom;

(c) rotating said second axis of rotation at a constant angular velocity $\omega_1$ about a third axis of rotation substantially parallel to said second axis of rotation and spaced a distance D/2 from said second axis of rotation;

wherein said pick-up member is spaced from said first axis so that said pick-up surface is at an outermost distance of $E_{nv}/2$ from said third axis;

and wherein $$(E_{nv}\times\omega_1)/2+\{((E_{nv}-D)\times\omega_2/2)+(((E_{nv}-D)/2-e)\times\omega_3)\}$$

substantially equals zero;

said method further comprising:

picking up said object with said pick-up member at a pick-up location along said trajectory; and releasing said object at an off-loading location along said trajectory.

39. The method of claim 38 wherein said second axis of rotation is rotated in a direction opposite the direction of rotation of said first and third axes of rotation.

40. The method of claim 39 wherein $\omega_2=-\omega_3$.

* * * * *